US005134726A

United States Patent [19]

Ross

[11] Patent Number: 5,134,726

[45] Date of Patent: Aug. 4, 1992

[54] SPORTS PANTS WITH PROTECTIVE PADS

[75] Inventor: Joseph T. Ross, Leawood, Kans.

[73] Assignee: Ross Athletic, Inc., Overland Park, Kans.

[21] Appl. No.: 742,876

[22] Filed: Aug. 9, 1991

[51] Int. Cl.[5] ..... A41B 13/06

[52] U.S. Cl. ..... 2/23; 2/22; 2/24; 2/227; 2/267; 2/2; 2/79

[58] Field of Search ..... 2/23, 22, 24, 227, 267, 2/2, 79

[56] References Cited

U.S. PATENT DOCUMENTS

| | | | |
|---|---|---|---|
| 1,406,794 | 2/1922 | Whitley | 2/23 |
| 1,602,454 | 10/1926 | Riddell | 2/23 |
| 3,670,339 | 6/1972 | Cooper et al. | 2/23 |
| 3,787,892 | 1/1974 | Quinn | 2/23 |
| 4,035,844 | 7/1977 | Atack et al. | 2/23 |
| 4,064,874 | 12/1977 | Valin | 2/22 |
| 4,091,466 | 5/1978 | Kearn | 2/23 |
| 4,287,884 | 9/1981 | Applegate | 128/80 |
| 4,287,885 | 9/1981 | Applegate | 128/80 |
| 4,455,686 | 6/1984 | Zide | 2/23 |
| 4,479,269 | 10/1984 | Balliet | 2/23 |
| 4,700,407 | 10/1987 | Mattila | 2/23 |
| 4,894,867 | 1/1990 | Ceravolo et al. | 2/23 |
| 4,920,577 | 5/1990 | Scharf | 2/22 |
| 4,987,613 | 1/1991 | Loverdi et al. | 2/23 |

*Primary Examiner*—Werner H. Schroeder
*Assistant Examiner*—Gloria Hale
*Attorney, Agent, or Firm*—Wm. Bruce Day

[57] ABSTRACT

A sports pants with protective pads includes a trunk and legs formed of elastically stretchable material with pockets in at least the hip and knee areas, and legs terminating in stirrup ends. At least groin, knee and hip areas have openable and closable pockets on interior surfaces of the pants for receipt of groin pads, hip pads, and knee pads of resilient foam material which are removable and replaceable in the pockets for protection of the wearer. The pads are removable for washing.

2 Claims, 2 Drawing Sheets

Fig. 1
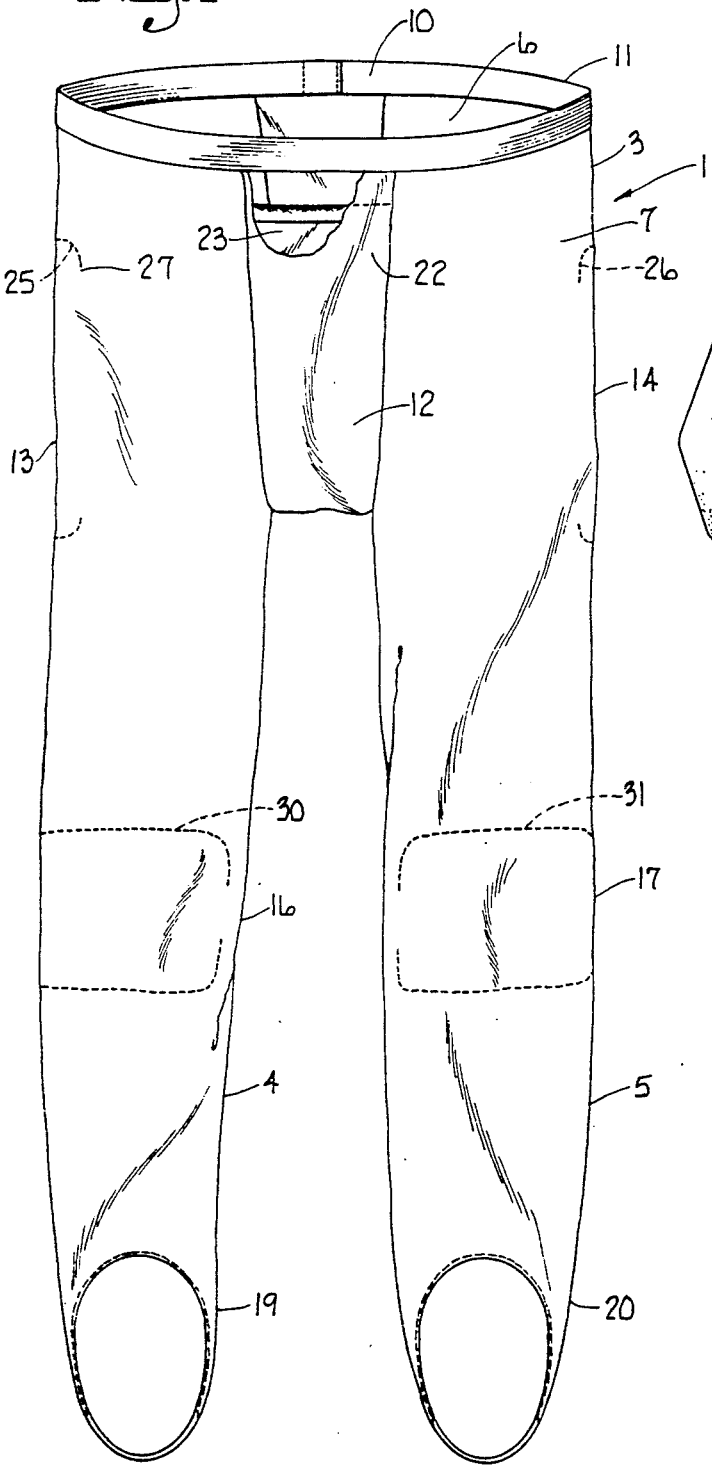
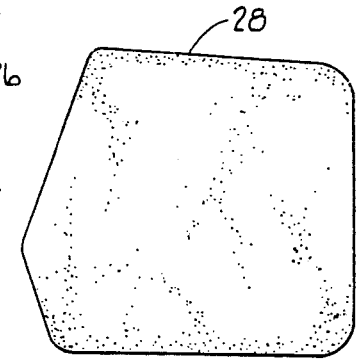
Fig. 2
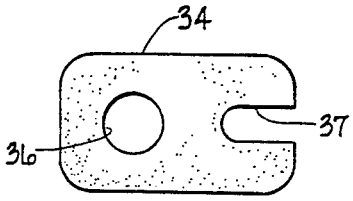
Fig. 3

SPORTS PANTS WITH PROTECTIVE PADS

FIELD OF THE INVENTION

This invention relates to a protective garment and particularly sports pants which protect the wearer of the garment.

DESCRIPTION OF THE RELATED ART

Protective garments are widely used in sports activities. In athletic games with quite active participation by a player, the possibility or indeed likelihood of physical contact of the players with balls, hockey sticks, sliding contact with ground, as in baseball or softball, is inevitable and sometimes bodily threatening. Various items of protective clothing have been developed and particularly for the baseball player, the player must often appear at the sports stadium several hours before game time in order to dress. Normally, first is donned a brief with protective groin cup, a girdle like garment worn over the briefs with hip pads sewn in, upper thigh pads, knee pads and finally, a garter belt added to hold up stockings. Tape may have to be applied to hold the various garments and assemblages in place. Finally, over the top of the various undergarments and pads, is worn the regular uniform pants outer garment.

Others have attempted to create special garments which were adapted to various sports, including undergarments with built-in pads, such as shown in Atack et al. U.S. Pat. No. 4,035,844. Other garments, such as shown in Loverdi et al. U.S. Pat. No. 4,987,613, are particularly adapted for the softball player and protect him or her for sliding into base. Nevertheless, the pads in this type of garment are not removable and replaceable for washing. When washed, the pads can tend to separate and bunch or lose their resiliency. Accordingly, a single piece of article of clothing which can be quickly and easily donned and correctly positions each of the many protective items and which can aid in holding up stockings would be of considerable benefit. Such an article of clothing would be of considerable benefit. Such an article of clothing would considerably reduce the amount of time involved in dressing for each game or practice.

OBJECTS OF THE INVENTION

The objects of the present invention are: to provide a sports underwear that correctly positions protective equipment against the body at desired points; to provide such a sports garment which will help to prevent scrapes and bruises in athletic competition and games; to provide such a sports garment which is easy to don and requires minimal attention to correct wearing; to provide such an article of sports clothing which is lightweight and easily washable; and to provide such an article of sports clothing which is economical to manufacture and suited for its intended purpose.

Other objects and advantages of this invention will become apparent from the following description taken in connection with the accompanying drawings, wherein are set forth, by way of illustration and example, a detailed embodiment of the invention.

BRIEF DESCRIPTION OF THE DRAWINGS

FIG. 1 is a front elevational view of a sports pants embodying the present invention.

FIG. 2 is an enlarged elevational view of a hip pad insertible into the sports pants.

FIG. 3 is an enlarged elevational view of a knee pad insertible into the sports pants.

DETAILED DESCRIPTION OF THE PREFERRED EMBODIMENT

Figure 4:
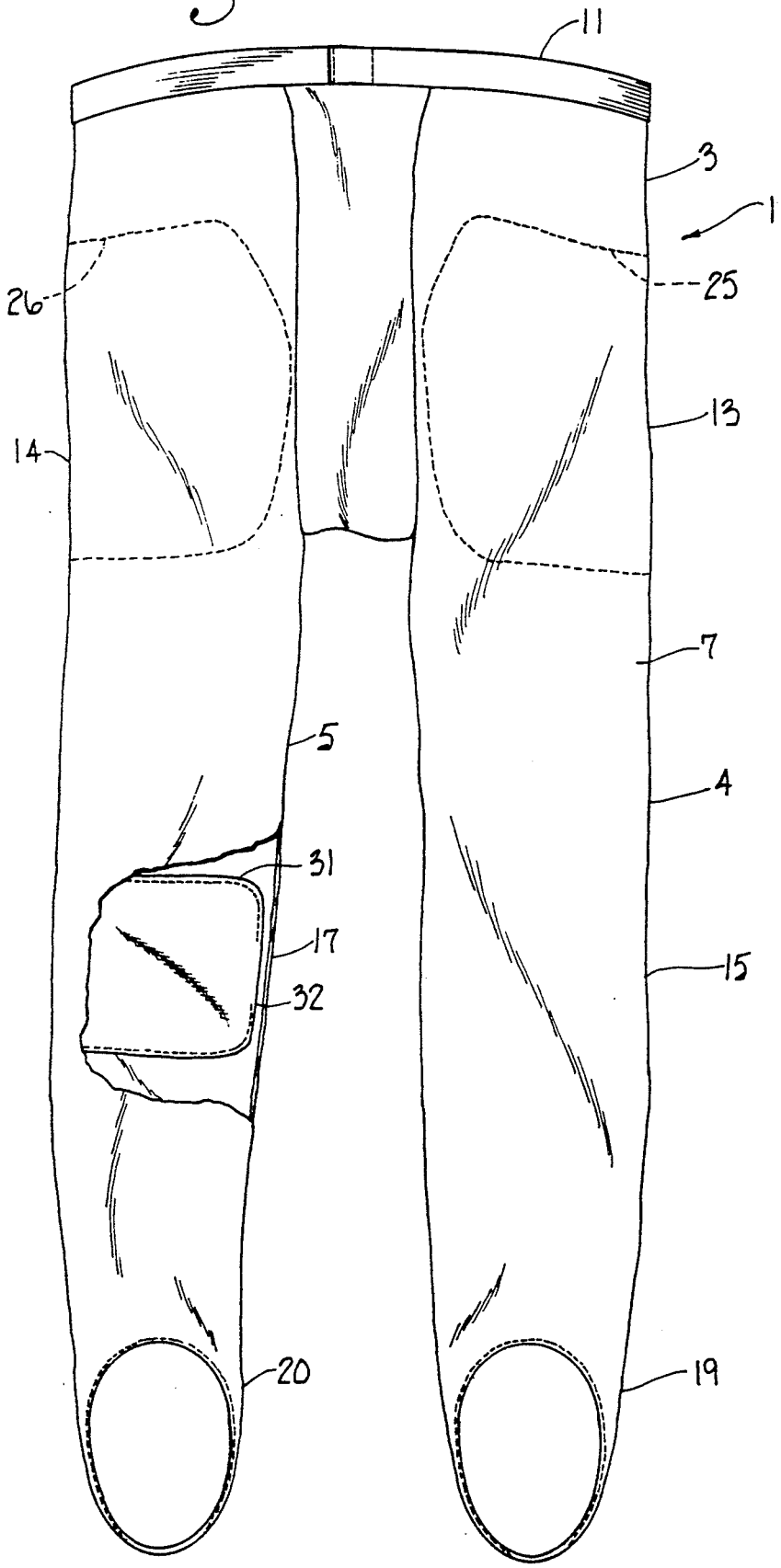
FIG. 4 is a rear, fragmentary, elevational view of the sports pants.

As required, a detailed embodiment of the present invention is disclosed herein. However, it is to be understood that the disclosed embodiment is merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

A sports pants, particularly suitable as an undergarment, is generally indicated by the reference Numeral 1, FIG. 1. The sports pants 1 is formed of a material which is elastically stretchable, both transversely and longitudinally, such as of a nylon and spandex material. The sports pants include a trunk portion 3 with legs 4 and 5 extending therefrom. The sports pants has inner and outer surfaces 6 and 7. The trunk portion 3 has an open top 10 encircled by an elastic closure strip 11 for securing about the waist of a wearer, a frontal groin or crotch area 12 and opposite sides 13 and 14 forming hip areas for covering the hips of a wearer. The legs 4 and 5 extend downwardly from the trunk portion 3 and have intermediate knee areas 16 and 17 with lower ends terminating in stirrup ends 19 and 20 for fitting about the feet.

At least the hip areas 13 and 14, crotch area 12 and knee area 16 and 17 have openable and closable pockets on the inner surfaces 6 to admit protective pads. In the illustrated example, a crotch area pocket 22 is elongate and is stitched on three sides to include a top access for receipt of a protective device such as a pad or cup 23. The hip areas 13 and 14 include respective hip pockets 25 and 26, also closed on three sides and particularly closed on the fourth side, and having a narrow access 27 to admit a protective pad 28, FIG. 2.

Knee pockets 30 and 31 are stitched to the inner surface 6 at the knee area 16 and 17, and similar to the hip pockets 25 and 26, include a three sided flap having an access 32 admitting knee pads 34, FIG. 3. Each knee pad 34 is generally in the shape of a rectangle with a generally centrally positioned circular hole 36 to admit the knee cap and a slot 37 to aid flexure and bending of the knee. The knee pad would, of course, be inserted into the respective pockets 30 and 31 so that the hole 36 is centered over the knee cap and the slot 37 is to the outside of the leg.

Preferably, the hip pads 28 and knee pads 34 are of a thin, resilient, closed cell foam material of about ¼" thickness and which is sufficiently sturdy to aid in sliding, as in sliding into a base, but still provide protection against significant abrasions and bruises to the wearer.

It is to be understood that the position or shape of the pads is not restricted to the example shown in connection with the figures, but can be variously sized to accommodate the larger or smaller areas of the thighs, knees, groin, etc. Moreover, although a particular material has been described in this specification, the material can be adopted as desired to suit the needed purpose. For example, the sports pants are intended to be used as underwear, but sufficient decorations or other material could be used which would make the pant more suitable for exterior wear, including, but not limited to, the use of fashion colors and designs. Although an elastic strip 11 is used at the top as an elastic closure, belt loops of larger or smaller dimension can be utilized as necessary or thought desirable for design purposes.

It is to be understood that while certain forms of the present invention have been illustrated and described herein, it is not to be limited to the specific form or arrangement of parts described and shown except insofar as set forth in the following claims.

I claim:

1. Sports pants comprising:

a) a trunk portion and legs formed of a material elastically stretchable transversely and longitudinally, with said trunk portion having an open top with means for securement about the waist of a wearer, a rear area for covering the buttocks of a wearer, a frontal crotch area, and opposite sides forming hip areas for covering the hips of a wearer, said trunk portion and said legs having exterior and interior surfaces;

b) said legs extending downwardly from said trunk portion, having knee areas, and terminating in stirrup ends for fitting about the feet of a wearer;

c) said knee areas and said hip areas having openable and closable pockets on said interior surfaces to include hip pad pockets and knee pad pockets; and d) hip pads and knee pads formed of resilient foam material and insertable into said pockets for protection of the hips and knees of a wearer, said knee pads including a central hole for fitting about the kneecap of a wearer and a slot area for ease of flexing.

2. Sports pants comprising:

a) a trunk portion and legs formed of a material elastically stretchable transversely and longitudinally and adapted for underwear, with said trunk portion having an open top with an elastic closure for securing about the waist of a wearer, a frontal crotch area, and opposite sides forming hip areas for covering the hips of a wearer, said trunk portion and said legs having exterior and interior surfaces;

b) said legs extending downwardly from said trunk portion, having knee areas, and terminating in stirrup ends for fitting about the feet of a wearer;

c) said hip area, crotch area, and knee areas having openable and closable pockets on said interior surface to include hip pad pockets, a crotch pad pocket and knee pad pockets; and d) hip pads, crotch pads and knee pads formed of resilient foam material and insertable into said pockets for protection of the wearer, said knee pads having apertures for fitting about the kneecap of a wearer and slots for flexure.

* * * * *